United States Patent [19]

Ritenour

[11] Patent Number: 4,692,091

[45] Date of Patent: Sep. 8, 1987

[54] LOW NOISE FAN

[76] Inventor: Paul E. Ritenour, P.O. Box 27318, San Diego, Calif. 92128

[21] Appl. No.: 779,059

[22] Filed: Sep. 23, 1985

[51] Int. Cl.[4] ..... F04D 29/66

[52] U.S. Cl. ..... 415/119; 415/210

[58] Field of Search ..... 415/119, 191, 210, 213 C, 415/200, 208

[56] References Cited

U.S. PATENT DOCUMENTS

| | | | |
|---|---|---|---|
| 2,650,752 | 9/1953 | Hoadley | 415/208 |
| 2,944,623 | 7/1960 | Bodine, Jr. | 415/119 |
| 2,973,716 | 3/1961 | Thomas | 415/200 |
| 3,346,174 | 10/1967 | Lievens et al. | 415/119 |
| 3,403,843 | 10/1968 | Cox | 415/210 |
| 3,618,700 | 11/1971 | Bond | 415/119 |
| 3,937,590 | 2/1976 | Mani | 415/119 |
| 3,976,393 | 8/1976 | Larson | 415/119 |
| 3,995,970 | 12/1976 | Nobuyki | 415/119 |
| 4,240,250 | 12/1980 | Harris | 415/119 |
| 4,475,867 | 10/1984 | Smith | 415/119 |

FOREIGN PATENT DOCUMENTS

| | | | |
|---|---|---|---|
| 2332443 | 6/1977 | France | 415/119 |
| 99097 | 6/1984 | Japan | 415/119 |

*Primary Examiner*—Robert E. Garrett
*Assistant Examiner*—John Kwon
*Attorney, Agent, or Firm*—Frank D. Gilliam

[57] ABSTRACT

A fan assembly provides for the compact and efficient movement of ambient air in areas requiring very low noise generation. In this new configuration, stationary turning vanes are placed at the air inlet followed by a sound cell, axial discharge fan and short axial (vaned) diffuser splitter sections. The stationary turning vanes induce a predetermined air rotation which provides a smooth rotating air flow into the rotating fan blades. The stationary turning vanes also block radiated noise from discharge through the air inlet and support the fan motor. The fan blades impart an opposite rotational momentum just sufficient to obtain an axial or nearly axial velocity discharge increment. The resulting axial fan discharge velocity is slowed in the short diffuser sections where diffuser vanes also block rear noise radiation. The slowed but pressurized air can now enter into an air distribution system with significantly reduced fan generated noise. Further noise reductions can be provided by inlet sound baffles, outlet acoustic diffuser splitters, and acoustic absorption materials in the inlet and short, rear axial diffuser short sections.

16 Claims, 5 Drawing Figures

LOW NOISE FAN

FIELD OF THE INVENTION

This invention relates to axial ventilation fans, and more specifically to fan systems requiring sound mufflers.

BACKGROUND OF THE INVENTION

The need for silent operation of ventilation systems is especially critical on board submarines, Naval surface vessels, HVAC systems, and other noise sensitive applications. Other locations, such as offices, ventilation systems require acoustic ceilings and other measures to reach acceptable noise criteria. In many cases, a major contributor to noise being generated is the ventilation fan. Axial ventilation fans are typically used in many applications because of their compact size and large flow capabilities.

Typically, in prior axial fan art, the inlet air flows directly into a rotating fan blade. In a compact duct fan, this can be preceded by an inlet cone, bellmouth or venturi section to accelerate the inlet air. The rotating fan blade imparts an axial and rotational (swirl) momentum component to the air. The fan discharge may include fixed turning vanes which removes the rotational or swirl component of the velocity but will increase noise at passing blade frequencies. A long discharge diffuser cone can also be provided to reduce velocity and improve static efficiency of the air distribution system; but also cause a total loss of pressure.

A uniform axial inlet air flow is required for maximum performance of prior art fans "without prerotation" (ASHRAE Handbook, 1983 Equipment Volume, Published by American Society of Heating, Refrigerating and Air-Conditioning Engineers, Inc. Atlanta, GA. ISSN: 0737-0687, page 39). Quoting this reference further, "One of the most detrimental flow conditions is one which permits spin to develop in the air stream approaching the inlet to the fan irrespective of the type. A spin in the direction of impeller rotation reduces volume flow and pressure; a reverse spin may not have a large effect on volume flow, but the power requirement increases".

In the prior art, fan generated noise was generally a given fact, and various bulky and heavy silencers or duct designs were used to muffle and isolate the fan noise. Low noise prior art fan designs did not alter the basic uniform axial inlet air flow requirement, but altered the size, speed, mounting and structure to reduce noise. Discharge turning vanes were provided to eliminate outlet swirl which increased static performance somewhat but induced an added noise component at passing blade frequencies.

The silencers at low speed fans of the prior art required additional cost and space. The outlet turning vanes sometimes increased noise significantly. The effectiveness of these prior art measures at reducing noise is not always totally satisfactory. The silencers may be effective in normal noise frequencies, but only partially effective at others. Because of space limitations, silencers are not feasible in many installations. The addition of outlet turning vanes may be effective in reducing outlet swirl but can add additional fan noise at the blade passing frequency. Changes in discharge pressure or volume flow to the distribution system would generally require a long diffuser, resulting in more space and increased losses. In addition, if the selected fan/silencer combination did not meet the noise criteria, major changes were generally required.

SUMMARY OF THE INVENTION

The principal and secondary objects of the invention are:

to provide an inherently axial quiet fan assembly without the normal need for upstream or downstream silencers;

to provide an efficient axial fan design over a range of inlet conditions and discharge pressures and volume flows;

to provide a sturdy, balanced and compact fan design for large capacity, low noise applications; and to provide a modular design which allows the easy tuning, replacement or substitution of components.

These and other objects are achieved by providing a fan assembly with inlet turning vanes cascading air to the rotating fan blades which are designed to accept a reverse preswirl to discharge air axially to a short vaned splitter diffuser sections, in a modular structure which separates the turning vanes and fan blades in a sound cell and diffuser. The modular structure provides access to tune, replace or add components. The turning inlet vanes and short diffuser vanes block radiated noise to provide an inherently quiet assembly. The axial vanes also provide efficient air handling, structural sturdiness and a compact size. The fan can be directly driven by an electric motor with suitable nose fairing, or other means. The stationary inlet turning vanes and outlet diffuser splitter vanes can be made from acoustic absorbent material to further reduce noise. The sound cell consists of acoustic absorbent material lining a chamber around the fan at a distance which reduces fan tip noise.

DESCRIPTION OF THE PREFERRED EMBODIMENT OF THE INVENTION

Figure 1:
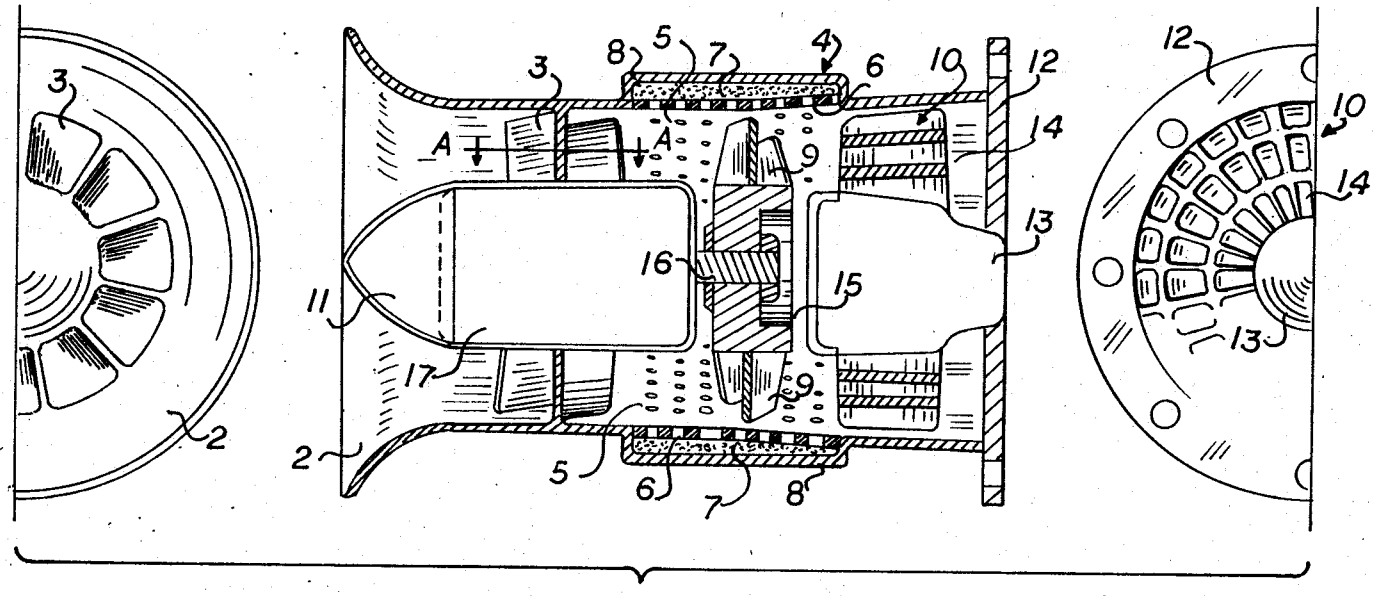
FIG. 1 is a cross-sectional view of an low noise fan.

Referring now to the drawing, FIG. 1 shows a cross-sectional view of a low noise fan assembly. Inlet bellmouth 2 accelerates the ambient air flow towards the inlet turning vanes 3. The venturi effect of the bellmouth 2 concentrates the air flow where it can be efficiently handled by the turning vanes 3. The turning vanes impart a swirling motion within the annular discharge area of the turning vanes 3. The discharged air enters a sound cell 4 which consists of a chamber 5, a discontinuous air flow surface 6, a noise insulating and acoustic absorbent filler material 7 outside the air flow passage but adjacent to the air flow surface 6, and an air tight structural containment surface 8 enclosing the sound cell 4. Within the sound cell are the fan blades 9. The clearance between the sound cell air flow surface 6 and the tips of the fan blades 9 is limited to reduce fan tip generated noise. At the sound cell discharge, a short diffuser 10 having splitter section is attached to reduce air flow velocity.

The inlet bell mouth 2 includes a nose fairing 11 which extends to a point adjacent to the fan blades 9 which provide the interior air flow annular surface. The diffuser 10 includes a discharge flange 12 to attach to an air distribution system (not shown for clarity) and a discharge fairing 13 which extends to a point adjacent to the fan discharge and provides an expanding interior annnular air flow surface. The nose fairing 11 is supported by the turning vanes 3. The discharge fairing 13 is supported by combined circular and radial diffuser vanes 14 which also act as flow splitters allowing a short diffuser section.

The air flow surface 6 within sound cell 4 is comprised of a cellular material which provides a generally smooth interior air flow surface but discontinuous to minimize noise or vibration transmission. Open or closed cell materials may be used. The insulating and filler material 7 is a composite of fiberous and metallic material which further damps noise or vibration. If minimum noise levels are desired, this type of construction with cellular air flow surface backed by insulating and filler material, contained by a structural surface, can also be used for the inlet bellmouth 2, nose fairing 11, and diffuser 10, including discharge fairing 13.

The chamber 5 must provide sufficient distance between the turning vane 3 and the fan blades 9, to allow the air flow to reach a relatively smooth swirl. This length is a function of specific design conditions and varies with airfoil types and velocities. This determined chamber dimension permits vortex and eddy currents caused by the turning vanes 3, to be effectively eliminated prior to fan blade passage. All fan dimensions are subject to proper aerodynamic design factors for pressure and volume requirements.

The fan blades 9 are attached to a hub 15 which is bolted to a shaft 16 which is driven by motor 17. The fan blades 9 are aerodynamically designed to sweep the preswirl induced by the turning vanes 3 rather than axial air flow. Swirling air flow is therefore designed to enter tangentially to the rotating fan blades, but exit nearly axially relative to the sound cell or fan rotation.

Figure 2:
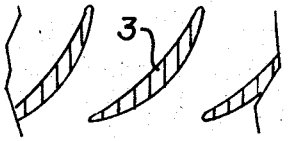
FIG. 2 is a cross-sectional view A—A of the turning vanes.

FIG. 2 shows the section A—A view of a turning vane 3. The turning vanes do not significantly alter the axial air velocity.

Figure 3:
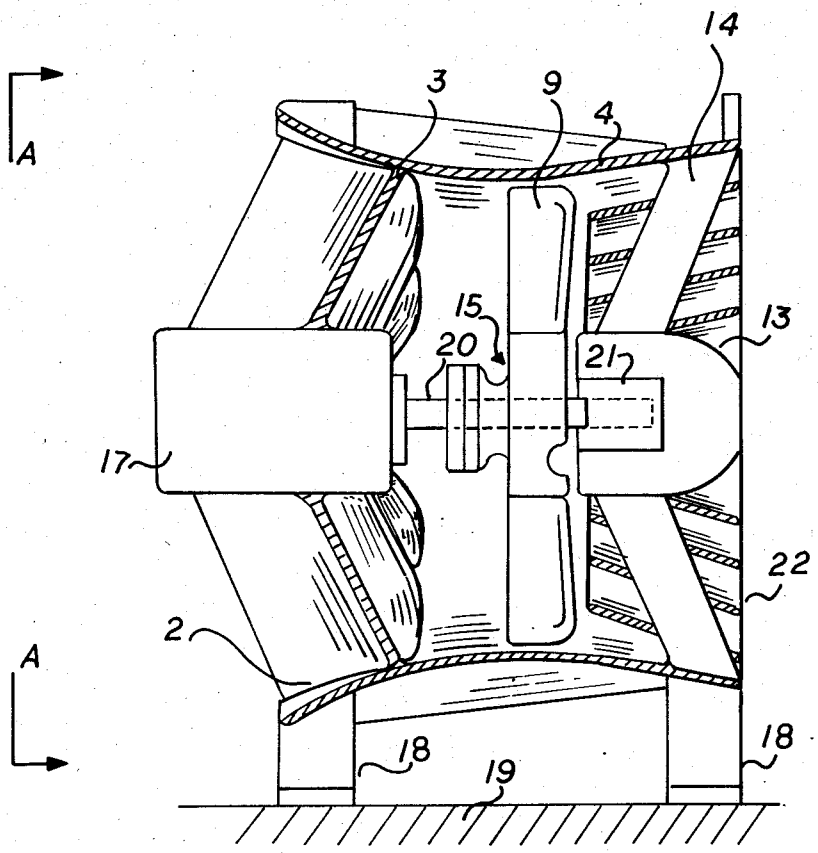
FIG. 3 is a cross-sectional view of a modular low noise fan for high capacity applications.

FIG. 3 shows an alternate configuration of low noise fan assembly for high capacity applications. Electric motor 17 is placed upstream of the entrance place of inlet bell 2. Inlet bell 2 is supported on mounts 18 attached to base 19. Mounts 18 also damp vibration and structural noise. Inlet bell 2 draws air from radial as well as axial locations, unrestricted by the upstream diameter of the motor 17. The motor is mounted and supported by inlet turning vanes 3 which prerotate the air prior to entry into fan blades 9. The fan blades 9 are attached to a hub 15 which is mounted on an extended shaft 20 driven by electric motor 17. A downstream bearing 21 stabilizes the extended shaft 20 and fan blades 9, further reducing vibration and noise. The downstream bearing 21 is supported by discharge fairing 13 which is supported by diffuser axial support vanes 14. Conical short diffuser vanes 22 allow improved diffusion in a short length and further block downstream radiated noise.

Figure 4:
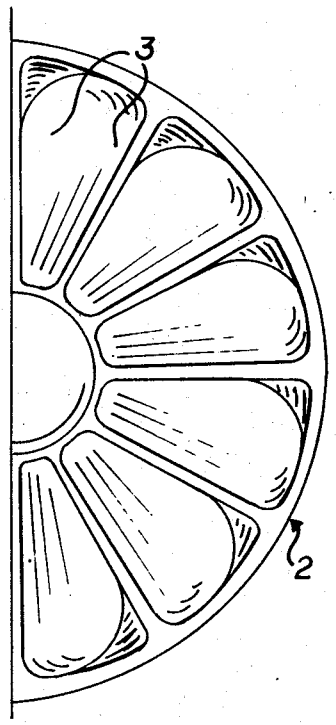
FIG. 4 is a front view of the high capacity application low noise fan.

FIG. 4 shows front view of low noise fan illustrated in FIG. 3. Inlet of Bellmouth 2 is shown containing turning vanes 3. The longer turning vanes 3 completely obstruct direct transmission of noise radiated from the interior of the low nose fan. Sound cell 4 construction is provided between fan blades 9 and radial and conical diffuser vanes 14, 22.

Figure 5:
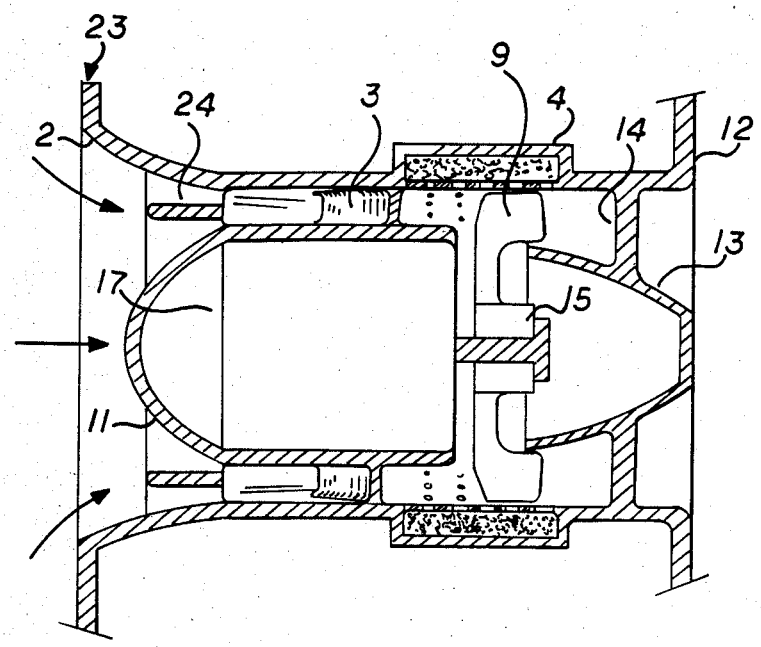
FIG. 5 is a cross-sectional view of a low noise fan for high pressure applications.

FIG. 5 is still another configuration illustrating a low noise fan assembly for a high pressure application. An inlet flange 23 is provided to accept pressurized air. Combined radial and circular acoustic splitter vanes 24 are provided upstream of turnng vanes 3 to provide additional noise reduction. both radial and axial acoustic splitter vanes are provided and are attached to inlet bellmouth 2 and nose fairing 11. Turning vanes 3 support electric motor 17 which drives hub 15 and fan blades 9. Diffuser vanes 14 support the diffuser fairing downstream of the fan. An outlet external pressurized duct to connect with an air distribution sytem (not shown for clarity). The diffuser vanes 14, diffuser fairing 13, sound cell 4 and inlet splitter vanes 24 are all constructed of acoustic absorbent materials to further reduce noise.

While the preferred embodiments of the invention in various configurations have been described, other embodiments and configurations may be devised without departing from the spirit of the invention and the scope of the appended claims.

What is claimed is:

1. A low noise axial flow fan assembly for suppling fluid to a fluid distribution system which comprises:

an external duct having fluid inlet and discharge means;

turning vane means within said duct adjacent to said inlet means for imparting a swirl velocity component to said fluid discharing from said turning vanes;

fan means spaced from said turning vane means for drawing said fluid through said inlet means and exiting said fluid out said exit means, said fan means having rotating blades configured to redirect said swirl velocity component of said fluid in a substantially axial direction through said discharge means; an axial vaned discharge means comprising short vaned diffuser sections position within said duct intermediate said fan means and said fluid discharge means;

acoustical means, positioned intermediate the discharge of said turning vane means and a place prior to said short vaned diffuser section for attenuating sound produced by fluid exiting said vane means and said rotating fan blades:

means to support and rotate said fan wherein said inlet turning vanes, when projected on a plane perpendicular to the axis of said fan, substantially covers the fluid flow area projection thereby substantially preventing sound from discharging from the space between said turning vane means and fan through said turning vane means, wherein said external duct inlet and diffuser sections consist of modular detachable segments, one segment enclosing said turning vanes, a second segment forming a sound cell, closely enclosing said fan tips and a third segment enclosing said short diffuser.

2. The fan assembly claimed in claim 1 which also comprises:

an internal fluid inlet fairing placed around the axis of said assembly, attached to said turning vane and enclosing said means to support and rotate said fan;

a hub attached to said fan, adjacent to said inlet fairing; and a discharge fluid fairing within said vaned discharge attached to radial vanes, forming the interior of a short vaned diffuser.

3. The fan assembly in claim 2 wherein said fluid is air.

4. The fan assembly claimed in claim 3 wherein said inlet means comprises a bellmouth inlet attached to said external duct system upstream of said inlet turning vanes for drawing ambient air.

5. The fan assembly claimed in claim 2 wherein means to support and rotate said fan consists of:

an electric motor attached to said fan within said inlet fairing; and a structural support within said inlet vanes supporting said motor and inlet fairing.

6. The fan assembly claimed in claim 5 wherein said inlet vane is composed of multiple sound absorbent material vanes.

7. The fan assembly claimed in claim 1 wherein said external duct is composed of sound absorbent material.

8. The fan assembly claimed in claim 7 wherein said short vaned diffuser sections consist of conical vane segments placed along said assembly axis supported by radial diffuser vanes.

9. The fan assembly claimed in claim 8 wherein said conical segment is composed of multiple sound absorbent material conical segments.

10. The fan assembly claimed in claims 9 wherein said conical segment (s), when projected on a plane perpendicular to the axis of said fan, covers a majority of the fluid flow projected area at the fan thereby substantially preventing turning vane means and fan generated noise from being discharged from said discharge means.

11. The fan assembly claimed in claim 10 which also consists of a downstream bearing for said fan supported by said radial diffuser vanes.

12. The fan assembly claimed in claim 11 wherein said radial diffuser vanes are composed of sound absorbent material.

13. The fan assembly claimed in claim 1 which also comprises:

an internal fluid inlet fairing of constant diameter placed around the axis of said assembly within said external duct enclosing a shaft attached to said fan and said means to support and rotate said fan;

a hub attached to said fan, adjacent to and with a diameter similar to said inlet fairing; and an interior discharge fairing attached to said radial discharge vanes and forming the interior of said vaned discharge.

14. The fan assembly claimed in claim 13 wherein said means to supply fluid consists of a bellmouth inlet attached to said external duct and said inlet turning vanes but downstream of said means to support and rotate said fan.

15. The fan assembly claimed in claim 1 wherein said sound cell is composed of a composite of fiberous and metallic material.

16. The fan assembly claimed in claim 1 wherein said acoustical means comprises a sound cell having a chamber with noise insulating and acoustic absorbent fill material therein with a discontinuous air flow surface adjacent to said turning vane discharge and tips of said fan blades for substantially attenuating the noise generated thereby.

* * * * *